United States Patent [19]

Hodge

[11] 4,112,334

[45] Sep. 5, 1978

[54] IGNITION SYSTEM FOR EXTENDING THE LIFETIME OF GAS FILLED ELECTRIC LAMPS

[75] Inventor: Leon Hodge, Garland, Tex.

[73] Assignee: Varo, Inc., Garland, Tex.

[21] Appl. No.: 763,500

[22] Filed: Jan. 28, 1977

[51] Int. Cl.[2] ..... H05B 37/02; H05B 41/18

[52] U.S. Cl. ..... 315/171; 315/175; 315/360; 315/DIG. 7; 315/172

[58] Field of Search ..... 315/DIG. 7, DIG. 5, 315/360, 160, 171, 175, 176, 163, 165, 166

[56] References Cited

U.S. PATENT DOCUMENTS

| | | | |
|---|---|---|---|
| 2,864,973 | 12/1958 | Scott | 315/176 X |
| 3,323,012 | 3/1967 | Seib | 315/174 |
| 3,436,595 | 4/1969 | Kneisley et al. | 315/165 |

*Primary Examiner*—Alfred E. Smith
*Assistant Examiner*—Charles F. Roberts
*Attorney, Agent, or Firm*—Richards, Harris & Medlock

[57] ABSTRACT

The specification discloses an igniter circuit for extending the lifetime of a gas filled electric lamp. The igniter circuit includes a D.C. boost converter for generating an open circuit D.C. voltage for application to the lamp prior to ignition of the lamp. A resistance is initially connected between the converter and the lamp in order to limit the current applied to the lamp to a first predetermined level. A timer is connected to be energized concurrently with the D.C. boost converter in order to generate a timing signal after a predetermined time interval. A relay is responsive to the timing signal in order to establish a short circuit across the resistance in order to increase the current applied to the lamp to a second predetermined level higher than the first level. Current is not increased to the second predetermined level if the lamp ignites prior to generation of the timing signal. In this manner, the gas filled electric lamp utilizes only the current level required to sustain ignition, and therefore, the lifetime and reliability of the lamp and of the D.C. boost converter is extended.

18 Claims, 2 Drawing Figures

IGNITION SYSTEM FOR EXTENDING THE LIFETIME OF GAS FILLED ELECTRIC LAMPS

FIELD OF THE INVENTION

This invention relates to igniter circuits, and more particularly relates to igniter circuits for igniting gas filled electric lamps.

THE PRIOR ART

Gas filled electric lamps are commonly used in a variety of purposes wherein high levels of light are required. In order to successfully ignite a gas filled electric lamp, such as a Xenon lamp or the like, three voltages are generally required. An initial voltage on the order of from 100 to 300 volts, termed an open circuit voltage, is applied to the anode of the Xenon lamp. A pulse of high voltage on the order of from 10 to 30 kilovolts is then applied across the electrodes of the Xenon lamp in order to ionize the enclosed Xenon gas within the lamp. The open circuit voltage is then maintained for a short time in order to sustain the discharge of the lamp until the ions form a plasma across the electrodes of the lamp. Thereafter, a relatively low voltage, known as the sustainer voltage, of the order of from 10 to 30 volts, is applied to the electrodes of the lamp in order to sustain the flow of plasma after the open circuit voltage is disconnected.

When Xenon lamps are relatively new, the lamps do not require high power levels in order to ignite. However, as the Xenon lamps age, the lamps gradually require additional power to obtain ignition. In previously developed ignition circuits for Xenon lamps, a D.C. boost converter is commonly utilized in order to apply the open circuit voltage prior to ignition. Normally, such D.C. boost converters generate sufficient current levels for ignition of any Xenon lamp, regardless of its age. Thus, relatively new Xenon lamps are often ignited with excessive power being applied thereto. Such excessive power tends to reduce the lifetime of Xenon lamps, inasmuch as lamp life is directly proportional to the number of ignitions and the power level in each ignition. Moreover, operating the D.C. boost converter at maximum power output not only uses excessive input energy, but also tends to reduce the reliability of the converter.

A need has thus arisen for an igniter system which provides the minimum power required for ignition of a gas filled electric lamp, thereby tending to improve the lifetime of the lamp, while minimizing energy requirements and improving the reliability of the D.C. boost converter.

SUMMARY OF THE INVENTION

The present invention substantially eliminates or reduces the problems heretofore inherent in prior igniters for gas filled electric lamps, and substantially increases the lifetime of such lamps by allowing the lamps to effectively seek their own power requirements for ignition.

In accordance with the present invention, an igniter circuit for extending the lifetime of a gas filled lamp includes circuitry for applying a first level of power to an electrode of the lamp prior to ignition of the lamp. Circuitry is then provided to increase the power applied to the electrode of the lamp to a second higher level if the lamp does not ignite within a prescribed time interval.

In accordance with yet another aspect of the invention, an igniter circuit for a gas filled electric lamp includes a voltage source for applying an open circuit voltage to an electrode or the like. Circuitry is provided to limit the current between the lamp and the voltage source for a predetermined time interval. Circuitry then eliminates the effect of the limiting means from between the lamp and the voltage source after the prescribed time interval if the lamp is not ignited.

In accordance with another aspect of the invention, an igniter circuit for extending the lifetime of a gas filled electric lamp includes circuitry for generating an open circuit igniting voltage for application to the lamp. Current limiting circuitry is connected between the generating circuitry and the lamp. A timer is provided to generate an indication of a predetermined time interval. Circuitry is responsive to the timer for removing the current limiting circuitry from between the generator circuitry and the lamp after the predetermined time interval.

In accordance with yet a more specific aspect of the invention, an igniter circuit for extending the lifetime of a gas filled electric lamp includes a D.C. boost converter for generating an open circuit D.C. voltage for application to the lamp prior to ignition of the lamp. A resistance is connected between the converter and the lamp for limiting the current applied to the lamp to a first predetermined level. A timer is connected to be energized concurrently with the converter for generating a timing signal after a predetermined time interval. Circuitry is responsive to the timing signal for establishing a short circuit across the resistance in order to increase the current applied to the lamp to a second predetermined level higher than the first level.

DESCRIPTION OF THE DRAWINGS

For a more complete understanding of the present invention and for further objects and advantages thereof, reference is now made to the following description, taken in conjunction with the accompanying drawings, in which.

DESCRIPTION OF THE PREFERRED EMBODIMENT

Figure 1:
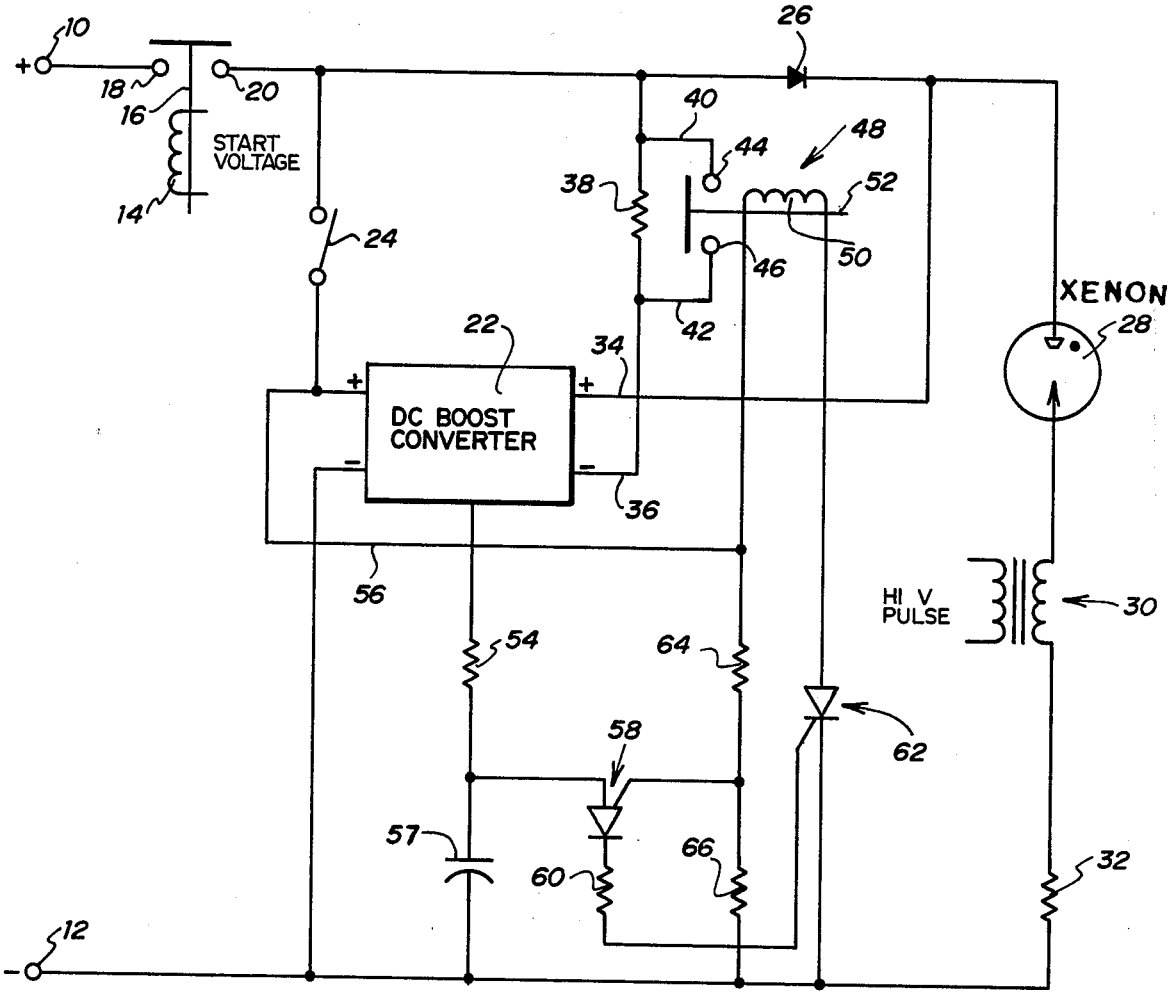
FIG. 1 is an electrical schematic of the preferred embodiment of the present igniter circuit.

Referring to FIG. 1, an electrical schematic of the preferred embodiment of the present igniter circuit is shown. A source of D.C. voltage is applied across a positive terminal 10 and a negative terminal 12. The source may comprise, for example, a storage battery for providing 28 volts D.C. across terminals 10 and 12. A power contactor solenoid or relay 14 is connected to be energized when a suitable starter button or switch, not shown, is depressed in the conventional manner. Energization of the power contactor solenoid 14 causes the solenoid armature 16 to close on contacts 18 and 20. The closing of the power contactor solenoid 14 causes the 28 volts D.C. to be applied to the igniter circuitry.

A D.C. boost converter 22 is connected at its positive input via a switch 24 to receive the positive D.C. voltage. The negative input of the D.C. boost converter 22 is connected directly to negative terminal 12. Boost converter 22 may comprise any one of a number of conventional boost converters which are operable to increase the 28 volts D.C. applied to its input to a D.C. voltage level of several hundred volts. As will be subsequently described, the converter 22 also includes spark gap circuitry for generating a series of high voltage pulses. The D.C. boost converter 22 also includes timing circuitry in order to terminate generation of the several hundred volt output after a predetermined time, such as six seconds, in order to prevent excessive demands on the system in case the lamp does not ignite within the time period. Switch 24 is normally closed when the present Xenon lamp is not ignited. The switch 24 will conventionally comprise a relay which is energized to open when current is sensed from the lamp through the ballast resistor, to be described.

The positive terminal 10 is applied through a blocking diode 26 to the anode of a gas filled electric lamp 28, which may comprise a Xenon lamp. The cathode of the Xenon lamp is connected in series with the secondary of a pulse transformer 30 which is adapted to receive momentary high voltage pulses having magnitudes of from 10 to 30 Kv in order to ignite the lamp in the conventional manner. The source of the high pulse voltage may be from a spark discharge circuit within the D.C. boost converter 22, or from any other conventional pulse source as is known in the art. In the preferred embodiment, a stepup transformer, not shown, is connected to the 200 volts output of the converter 22 in order to step the voltage up to 8000 volts. This voltage is then applied across a spark gap which is associated with a capacitor, also not shown. The spark gap and capacitor result in high voltage pulses being applied to the primary of transformer 30.

The high voltage pulses applied to transformer 30 are provided at a rate dependent upon the ignition characteristics of the lamp 28. Normally, a number of pulses are repeatedly applied until the lamp is ignited, or until the timer in the D.C. boost converter 22 terminates operation of the converter.

The secondary of transformer 30 is connected through a ballast resistor 32 to the negative terminal 12. The positive output of the D.C. boost converter 22 is connected via a lead 34 directly to the anode terminal of the Xenon lamp 28. The negative output of the D.C. boost converter 22 is connected via lead 36 through a resistor 38 to the anode of the blocking diode 26.

An important aspect of the invention is the provision of a shortable circuit across resistor 38 which includes leads 40 and 42 which terminate in contacts 44 and 46. A solenoid or relay 48 includes a coil 50 energizable by the timing circuit to be subsequently described, along with an armature 52. Upon energization of the relay coil 50, the armature 52 is moved to short against contacts 44 and 46 in order to provide a shorting path across the resistor 38. Resistor 38 in this mode of operation is essentially removed from the circuit, and thus, the effective current from the D.C. boost converter 22 is substantially increased.

The timing circuitry of the inverter of the invention includes a resistor 54 which is connected via lead 56 to the positive input of the D.C. boost converter 22. Resistor 54 is connected to a capacitor 57 having an electrode tied to the negative terminal 12. The juncture between resistor 54 and capacitor 57 is tied to an electrode of a programmable unijunction transistor 58. A second electrode of the transistor 58 is connected through a resistor 60 to the cathode gate electrode of an SCR 62. The third terminal of the transistor 58 is connected to a voltage divider comprising resistors 64 and 66 which is tied across lead 56 and the negative terminal. The relay coil 50 is connected to one terminal of resistor 64 and to the anode of the SCR 62. The cathode of the SCR 62 is connected to the negative terminal 12.

The present circuit may be used with Xenon lamps of power requirements varying from 300 watts to 2.2 kilowatts, for example. As is known, Xenon lamps of different power require different power for ignition. As an example of operation of the present circuit, it will be assumed that lamp 28 is a one kilowatt Xenon lamp which will require approximately 40 amperes maximum current for ignition. In this embodiment, resistor 38 will be provided with a magnitude to provide current flow of 20 amps. When the resistor 38 is shorted, the current flow through the diode 26 will be 40 amps. In the case of Xenon lamps of different power requirements, different magnitudes of resistor 38 will be required.

Figure 2:
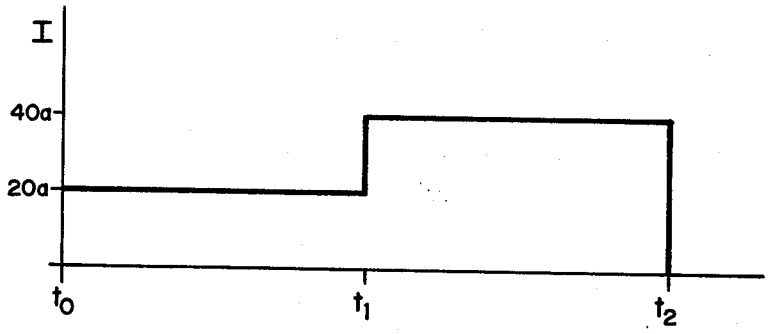
FIG. 2 is a somewhat diagrammatic graph illustrating a typical operation of the circuit of FIG. 1 during the ignition of a gas filled electric lamp.

FIG. 2 diagrammatically illustrates the two current levels generated by the present igniter system. In operation, when the power contactor solenoid 14 is initially energized, power is applied to the D.C. boost converter 22 which applies an open circuit voltage of several hundred volts to a terminal of an electrode of the Xenon lamp 28. In this mode of operation, the switch 24 is closed inasmuch as no current is flowing through the secondary of the transformer 30 or through the ballast resistor 32. The circuitry for detecting the flow of current through the ballast resistor 32 and for controlling the operation of the switch 24 is not shown inasmuch as it is conventional circuitry. When switch 24 is closed, a voltage of 200 volts is applied across the resistor 38, and therefore a current of approximately 20 amps flows therethrough. This results in electrical power of a predetermined level being applied to the anode of the lamp 28. The 20 amps continue to flow through resistor 38 for a predetermined timing interval as determined by the timing circuitry of the invention.

As shown in FIG. 2, this timing interval comprises the interval between $t_0$–$t_1$. During the first time interval $t_0$–$t_1$, high voltage pulses are periodically applied to the transformer 30. When the lamp 28 is relatively new, the application of the 20 amp current level in conjunction with the high voltage pulses will normally be sufficient to cause ignition of the lamp 28. When lamp 28 ignites, current flow is sensed across the ballast resistor 32, and the switch 24 is therefore opened. This causes the D.C. boost converter 22 to be deenergized, and the ignition of lamp 28 is then sustained by application of the 28 volts D.C. applied to terminals 10 and 12. When boost converter 22 is deenergized, the timing circuitry of the invention is also terminated and is reset. When the lamp 28 is ignited, and it is desired to terminate energization of the lamp 28, the power contactor relay 14 is deenergized and power is no longer applied to the lamp 28.

At the end of the timing interval $t_0$–$t_1$, if the lamp 28 has not ignited, the SCR 62 is rendered conductive by the timing circuitry in order to actuate the relay coil 50. The armature 52 then closes against contacts 44 and 46, thereby effectively shorting the resistor 38. This causes the current flowing through leads 40 and 42 to substantially increase, thereby increasing the power applied to the anode of the lamp 28. As shown in FIG. 2 in the preferred embodiment, the current is increased to a level of 40 amps from the period of $t_1$–$t_2$. During time interval $t_1$–$t_2$, the high voltage pulses are again repeatedly applied to transformer 30. If the lamp 28 ignites during time period $t_1$–$t_2$, switch 24 is opened, and the boost converter 22 is deenergized as previously noted.

If the lamp 28 does not ignite during time period $t_1$–$t_2$, the timing circuitry, not shown, in the D.C. boost converter 22 automatically opens switch 24 to prevent excessive demands on the converter.

In operation of the timing circuitry, application of the 28 volts D.C. to terminals 10 and 12, when the power contract relay 14 is closed and switch 24 is closed, causes the timing capacitor 57 to begin to charge toward the 28 volts D.C. via the timing resistor 54. The values of capacitor 57 and resistor 54 are such that the voltage at the juncture thereof reaches approximately ten volts in the prescribed time 1, $t_0$–$t_1$, which in the preferred embodiment is 3 seconds. This ten volts is applied to the anode of the programmable unijunction transistor 58, thereby forcing the transistor 58 into the conductive state. This causes the capacitor 57 to be discharged through the transistor 58 to the cathode junction of the SCR 62. The SCR 62 then conducts heavily and actuates the relay coil 50 in order to short out the resistor 38 from the circuit as previously described.

The resistor 60 restricts the peak gate current through the SCR 62 to less than 10 milliamperes in order to protect the SCR 62. The value of the anode voltage at which transistor 58 conducts is determined by the values of resistors 64 and 66 which form a programmable voltage divider. These resistors may be made variable in order to change the time interval to $t_0$–$t_1$ as desired. The present circuit is reset to initial operating conditions after removal of the 28VDC by opening of the power contractor relay 14.

It will thus be seen that the present invention provides a first current level during a predetermined time interval, such current having a magnitude sufficiently high to ignite the lamp 28 when the lamp 28 is relatively new. As the lamp 28 ages, and therefore requires a higher starting current, the present igniter circuitry, after the predetermined time interval, automatically applies a higher current in order to ignite the lamp. In this manner, the lamp 28 is not subjected to the higher current unless it is required for ignition. The present circuit has been found to substantially increase the lifetime of Xenon lamps and has substantially improved the reliability of D.C. boost converters.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. In an igniter circuit for a gas filled electric lamp wherein a voltage source applies an open circuit voltage to an electrode of the lamp, the improvement comprising:

means for limiting the current between the lamp and the voltage source for a predetermined time interval, means for eliminating the effect of said limiting means from between the lamp and the voltage source after said predetermined time interval if the lamp is not ignited in order to increase the power applied to the lamp, said eliminating means including timing means for generating a control signal at the end of said time interval, and means responsive to said control signal for eliminating the effect of said limiting means, said means including an electronic switch for being energized by said control signal, a relay for being energized by said switch, and a shorting path about said limiting means which is completed by energization of said relay.

2. The combination of claim 1 wherein the current applied to the lamp during said time interval is lower than the current applied after said time interval in order to increase the lifetime of the lamp.

3. The combination of claim 1 wherein said limiting means comprises a resistance.

4. The combination of claim 1 wherein said eliminating means comprises:

a relay operable to complete a shorting circuit around said limiting means.

5. An igniter circuit for extending the lifetime of a gas filled electric lamp comprising:

a blocking diode connected in series with the lamp, means connected across said blocking diode for generating an open circuit igniting voltage for application to the lamp, current limiting means connected between said generating means and the lamp, timing means for generating a signal representative of a predetermined time interval, and means responsive to said signal of said timing means for removing said current limiting means from between said generating means and the lamp after said predetermined time interval.

6. The igniter circuit of claim 5 wherein said current limiting means comprises a resistance connected between said generating means and said blocking diode.

7. The igniter circuit of claim 6 wherein said means for removing comprises a shorting path connected across said resistance.

8. The igniter circuit of claim 5 wherein said timing means is initiated when said generating means is energized.

9. The igniter circuit of claim 5 wherein said timing means generates a control signal when said predetermined time interval expires, and switch means responsive to said control signal for removing said current limiting means.

10. The igniter circuit of claim 9 and further comprising:

a relay operable by said switch for closing a shorting path across said current limiting means.

11. The igniter circuit of claim 9 wherein said switch means comprises a SCR having a control electrode connected to receive said signal from said timing means.

12. An igniter circuit for extending the lifetime of a gas filled electric lamp comprising:

a D.C. boost converter for generating an open circuit D.C. voltage for application to the lamp prior to ignition of the lamp, a resistance connected between said converter and the lamp for limiting the current applied to the lamp to a first predetermined level, timing means connected to be energized concurrently with said converter for generating a timing signal after a predetermined time interval, and means responsive to said timing signal for establishing a short circuit across said resistance in order to increase the current applied to the lamp to a second predetermined level higher than said first level.

13. The igniter circuit of claim 12 and further comprising means for deenergizing said converter when said lamp is ignited.

14. The igniter circuit of claim 12 and further comprising:

means for applying a high voltage pulse for striking an arc in the lamp, and means for applying a low sustaining voltage to the lamp after the lamp has ignited.

15. The igniter circuit of claim 12 wherein the lamp comprises a Xenon lamp.

16. The igniter circuit of claim 12 wherein said first predetermined level is one-half the magnitude of said second predetermined level.

17. The igniter circuit of claim 12 wherein said means for establishing a short circuit comprises:

an electronic switch which is energized by said timing signal, and a relay energized by said switch for establishing said short circuit.

18. The igniter circuit of claim 12 and further comprising:

a blocking diode connected in series with the lamp, said D.C. boost converter connected across said blocking diode.

* * * * *